US005153411A

United States Patent [19]

Ndebi

[11] Patent Number: 5,153,411

[45] Date of Patent: Oct. 6, 1992

[54] FUSER ROLLER HAVING SURFACE-TEMPERATURE REDUCING MEMBER

[75] Inventor: Sylvain L. Ndebi, Rochester, N.Y.

[73] Assignee: Eastman Kodak Company, Rochester, N.Y.

[21] Appl. No.: 843,761

[22] Filed: Feb. 28, 1992

[51] Int. Cl.[5] ..... H05B 1/00

[52] U.S. Cl. ..... 219/216; 219/244; 355/30; 355/285

[58] Field of Search ..... 355/30, 282, 285, 289, 355/290, 295; 219/216, 243, 244

[56] References Cited

U.S. PATENT DOCUMENTS

| | | | |
|---|---|---|---|
| 3,945,726 | 3/1976 | Ito et al. | 355/384 |
| 4,042,804 | 8/1977 | Moser | 219/216 |
| 4,253,392 | 3/1981 | Brandon et al. | 100/155 R |
| 4,594,068 | 6/1986 | Bardutzky et al. | 432/60 |
| 4,780,078 | 10/1988 | Masui | 355/289 |
| 4,888,464 | 12/1989 | Shibata et al. | 219/216 |
| 4,933,724 | 6/1990 | Sugimoto et al. | 355/289 |
| 5,075,732 | 12/1991 | Menjo | 355/282 |
| 5,099,288 | 3/1992 | Britto et al. | 355/290 |

*Primary Examiner*—A. T. Grimley
*Assistant Examiner*—Sandra L. Brasé
*Attorney, Agent, or Firm*—Tallam I. Nguti

[57] ABSTRACT

A heat and pressure roller-type fusing apparatus for fusing toner images onto a substrate includes a fuser roller which has a hollow metallic core and at least an elastomeric outer layer that is formed over the core. A heat source is mounted within the metallic core for heating such core and the elastomeric layer to a desirable fusing temperature. The fuser roller includes a first length portion which is substantially equal to the cross-track dimension of the substrate for contacting the substrate, and a second length portion which adjoins the first length portion and an end of the fuser roller. The fuser roller also includes a heat absorbing and dissipating member that is mounted inside the hollow core for inwardly absorbing and dissipating heat from the core within the second length portion of the fuser roller, thereby reducing the heating and temperature of the surface of such second length portion of the fuser roller.

8 Claims, 1 Drawing Sheet

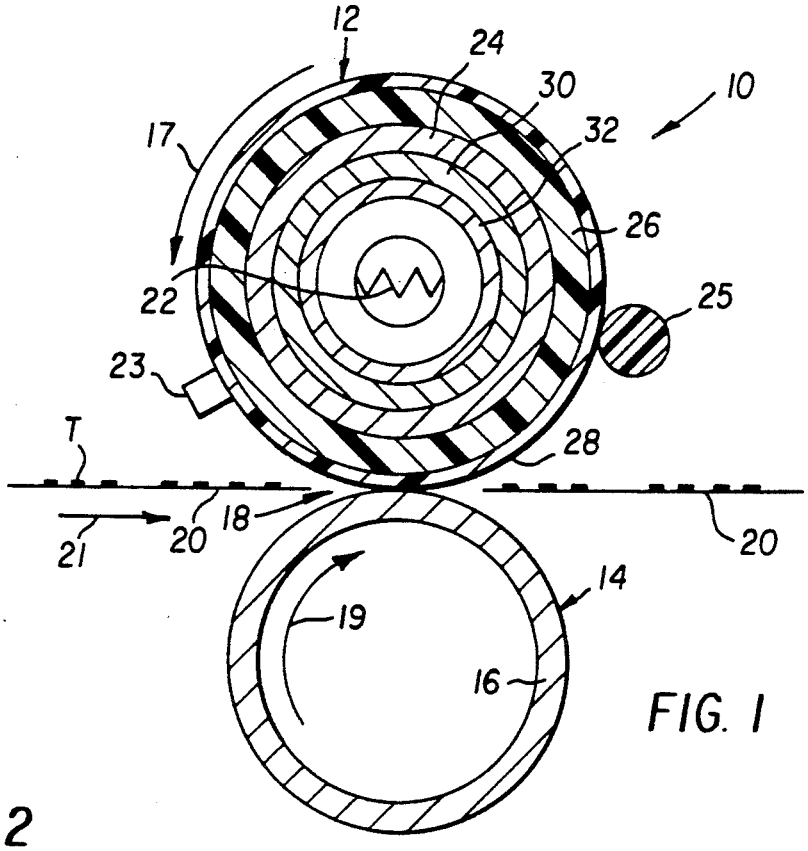
FIG. 1
FIG. 2
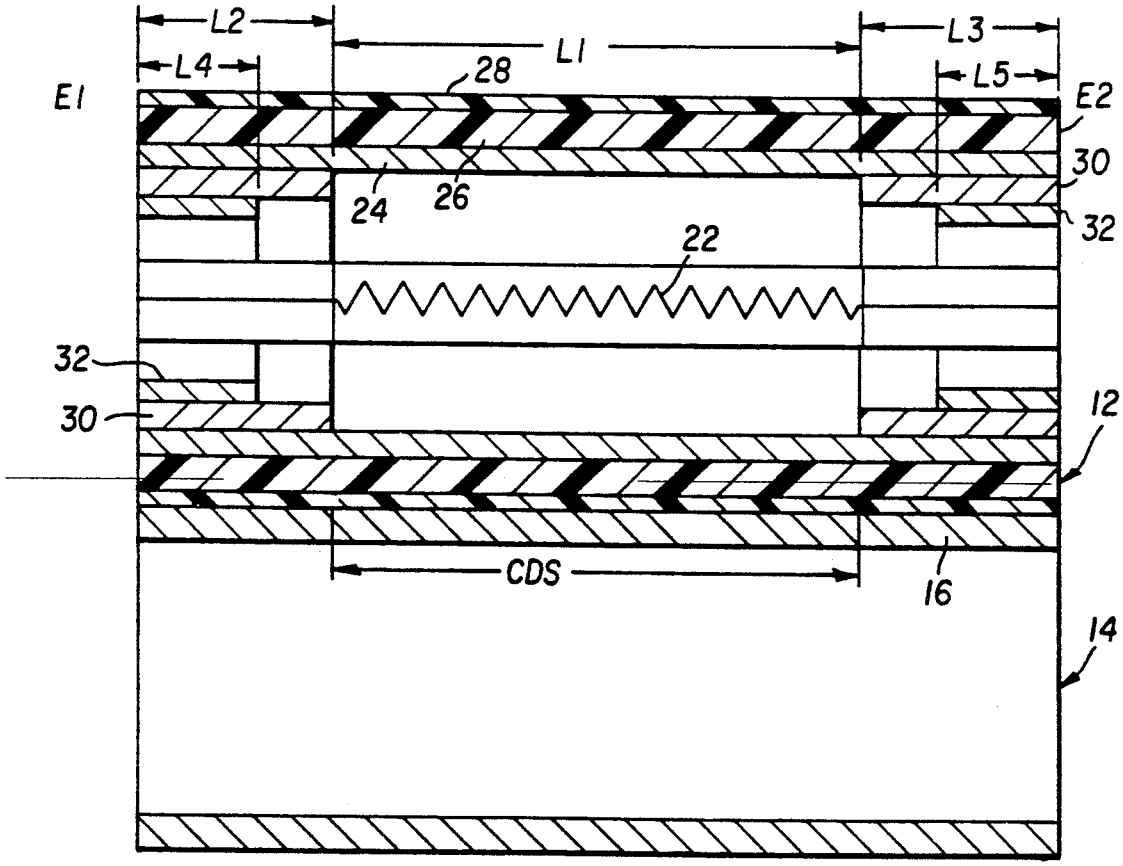

FUSER ROLLER HAVING SURFACE-TEMPERATURE REDUCING MEMBER

BACKGROUND OF THE INVENTION

1. Field of the Invention

The present invention relates to electrostatographic fusing apparatus, and more particularly to a fuser roller for use in a heat and pressure roller-type fusing apparatus.

2. Description Relative to the Prior Art

Electrostatographic reproduction machines such as copiers and printers, are well known. Such copiers and printers include pressure and fuser rollers which are used in heat and pressure roller-type fusing apparatus therein for fusing toner images onto a sheet or substrate. For various advantages, and in order to solve various problems, some such pressure and fuser rollers are provided with particular shapes and geometries as disclosed for example in U.S. Pat. No. 3,945,726 issued Mar. 23, 1976 to Ito et al; U.S. Pat. No. 4,042,804 issued Aug. 16, 1977 to Moser; 4,253,392 issued Mar. 3, 1981 to Brandon et al; U.S. Pat. No. 4,594,068 issued Jun. 10, 1986 to Bardutzky et al; and 4,933,724 issued Jun. 12, 1990 to Sugimoto et al.

For example, in the '724 patent the walls of the core of the fuser roller are reduced in thickness for improved heat distribution. In the '068 patent the pressure roller is tapered in order to modify the speed of such a roller relative to the speed of a cylindrical pressure roller. In the '392 patent means are provided for tapering and untapering the ends of a pressure roller in response to changes in ambient humidity. In the '804 patent the pressure roller is tapered in order to achieve faster speeds at its ends in order to prevent copy sheet wrinkling, and in the '726 patent it is suggested to paint the inside of, or otherwise increase the density of the ends of a tubular fuser roller, in order to improve its thermal efficiency at such ends.

Typically, however, each fuser roller that is internally heated includes a generally cylindrical heat conductive metallic core, an internal heat source such as a lamp, and an elastomeric layer made for example of silicone rubber formed over the core. In order to effectively melt and fuse toner images in a fusing apparatus which includes such a fuser roller, the roller must be heated so that its surface reaches a particular temperature control point. The temperature of the surface is usually maintained at such a control point with the help of a temperature sensor which may be positioned on such surface and towards an end of the fuser roller. As is well known in the art, running copy sheets or substrates over sheet contacting portions of the heated fuser roller during fusing periods results in heat dissipation or loss from the surface of the fuser roller to the sheets or substrates.

As such, the temperature of the sheet contacting portions of the fuser roller is likely to be lower than that of the other, for example end portions which are not contacted by the sheets or substrates. Accordingly, during running or fusing periods of the fusing apparatus heat therefore builds up in such end portions of the fuser roller, resulting in high surface temperature surges in the end portions of the fuser roller. The high temperature surges at these end portions of the fuser roller can detrimentally affect the effectiveness of the temperature sensor if located thereat, as described above. In addition, the heat build up causing such high temperature surges can also undesirably cause the metallic core to warp or crack within such end portions. The result, of course, can be less than desired fusing quality due to poor control of fusing nip geometry and pressures, as well as poor surface temperature control, and hardware damage.

SUMMARY OF THE INVENTION

It is an object of the present invention to provide a fuser roller that overcomes temperature-surging problems of conventional fuser rollers.

In accordance with the present invention, a fuser roller is provided for use in a heat and pressure roller-type fusing apparatus for fusing toner onto an image carrying substrate. The fuser has a hollow metallic core, an elastomeric layer, and an internal heat source for heating the core such that the surface of the elastomeric layer is in turn heated to a desired fusing temperature. The fuser roller includes a first length portion which is substantially equal to the cross-track dimension of the image carrying substrate and is adapted for contacting such substrate. The fuser roller also includes a second, end length portion which adjoins the first length portion as well as an end of the fuser roller, and which does not contact such substrate. To reduce the surface temperature of such second, end length portion of the fuser roller, the fuser roller further includes a heat absorbing and diffusing member mounted within the core for absorbing and dissipating heat from the core in such a second length portion, thereby reducing the heating and temperature of the elastomeric layer in such second length portion of the fuser roller.

BRIEF DESCRIPTION OF THE DRAWINGS

In the detailed description of the invention presented below, reference is made to the drawings, in which:

FIG. 1 is a cross-sectional view of a heat and pressure roller-type fusing apparatus including the fuser roller of the present invention; and FIG. 2 is a longitudinal section of the fusing apparatus of FIG. 1.

DETAIL DESCRIPTION OF THE INVENTION

Because heat and pressure roller-type fusing apparatus as used in electrostatographic reproduction apparatus such as copiers and printers are well known, the present description will be directed in particular to only elements of such an apparatus that form part of, or cooperate in the present invention. Elements of such an apparatus not specifically shown or described are assumed to be selectable from those known in the prior art.

Referring now to FIG. 1, a heat and pressure roller-type fusing apparatus of the present invention is illustrated generally as 10. The fusing apparatus 10 includes the fuser roller of the present invention shown generally as 12, and a pressure roller 14 which has a generally cylindrical outer shape. The pressure roller 14 may consist of a metallic (aluminum) core 16 which is mounted so as to form a fusing nip 18 with the fuser roller 12. As shown, both the fuser roller 12 and pressure roller 14 as mounted can be rotated by suitable means (not shown) in the direction of the arrows 17 and 19 respectively in order to feed an image carrying substrate 20 through the fusing nip 18 in the direction of the arrow 21. The substrate 20 is fed thus through the nip 18 such that a toner image T thereon directly faces and contacts the fuser roller 12. For fusing the toner image T onto the substrate 20, the fuser roller 12 is heated for example internally by a heat source, such as a lamp 22 so that the surface of the fuser roller 12 reaches a desired fusing temperature. The surface temperature of the fuser roller as such can be sensed by means for example of temperature sensor 23. The sensor 23 for example may be mounted to contact the surface of the fuser roller at a point near an end portion of the fuser roller 12.

In order to prevent the image T from offsetting from the substrate 20 to the roller 12, a device such as a wicking or oiling roll 25 may be mounted against the fuser roller for applying toner release oil to the surface of such fuser roller 12. Additionally as is well known in the art, suitable means (not shown) are provided for loading or forcing the pressure roller 14 into fusing nip forming contact with the fuser roller 12.

Referring now to FIGS. 1–2, the fuser roller 12 of the present invention has an overall length that is greater than the cross-track dimension of the substrate 20, and first and second ends shown respectively as E1 and E2. As shown fuser roller 12 comprises a rigid core 24 for example a hollow metallic core made of aluminum, and at least one elastomeric outer layer 26 made of silicone rubber. A second outer layer such as the layer 28, which preferably is impervious to the release oil being applied by the device 25, may also be formed over the first layer 26. Overall the fuser roller 12 has a generally cylindrical outer shape or profile adapted for contacting the generally cylindrical pressure roller 14 in order to form the fusing nip 18. Fuser roller 12 which is longer than the cross-track dimension of the substrate 20, includes a first length portion shown as L1 which is preferably centered, and which by design comes into direct heating contact with the substrate 20 during a fusing cycle or period of the fusing apparatus 10. The first length portion L1 of the roller 12 as such is therefore substantially coextensive with the cross-track dimension, shown as CDS, of the substrate 20. As further shown, the fuser roller 12 includes a pair of second length portions L2 and L3 which lie one at each of the first and second ends E1, E2 respectively of the fuser roller 12. Each second length portion L2, L3 adjoins the substrate-contacting first length portion L1, as well as such respective end E1 or E2. Consequently, each such second length portion L2, L3 lies beyond the reach of, and therefore does not contact a substrate 20 being moved contactably with the first length portion L1.

The heat source 22 as shown, may be provided such that it is centrally located within the core 24, and such that it is coextensive with the first length portion L1 of the roller 12. As such, when the heat source or lamp 22 is turned on, it quickly heats the air between it and the interior surface of the core 24. It then heats the core 24 principally in a radial direction within the first length portion L1, and the heated core 24 then in turn radially and conductively heats the elastomeric layer 26, which then conductively heats the outer layer 28 consistent with a decreasing-temperature gradient relative to the position of the source of heat 22. Meanwhile, the second length portions L2, L3 of the heated core 24 also become heated conductively through longitudinal heat flow from the directly lamp-heated and understandably higher temperature first length portion L1 thereof. Consequently, the elastomeric layers 26, 28 in the second length portions L2, L3 thereof similarly then also become heated mainly radially and conductively by such heated core of the second portions L2, L3.

During standby periods (these are periods during which no substrates 20 are being fed through the nip 18), the heat source 22 is turned on but for the purpose of maintaining the temperature of the fuser roller 12 at a desired standby temperature which is lower than the fusing temperature. Such a standby temperature can be controlled as is well known with the help of the sensor 23. Normally, such a standby temperature is substantially uniform, and therefore varies insignificantly between the first and second ends E1, E2 of the fuser roller 12. As such substantially the same idle or standby temperature for example 360° F. can be measured at a point P1 within the first length portion L1, and at a point P2 within a second length portion such as L2.

Unfortunately however, during the run period of the fusing apparatus 10, when substrates 20 are being fed contactably through the fusing nip 18, the heated first length portion L1 of the fuser roller losses significant amounts of heat therefrom to such substrates 20. Such loss of heat results in a drop in temperature over such first length portion L1. For example, given a uniform standby temperature of about 360° F. at the points P1 and P2, run period temperature measurements at these same points P1, P2 showed a temperature of 335° F. at point P1 (within the first length portion L1, a difference of −25° F. from the standby temperature of 360° F.), and a temperature of 435° F. at point P2 (within the second length portion, a difference of +75° F. from the standby temperature of 360° F.).

Apparently, while the first length portion L1 was losing heat to the substrates 20, heat was building up in the second portions L2, thus resulting in the undesirable temperature-surge from 360° F. to 435° F. as measured in the example above. The same temperature-surge can of course be measured within the other second length portion L3 of the roller 12. The accumulation of heat, and hence such a temperature surge over the second length portions L2 as such are of course undesirable because they detrimentally affect efforts to accurately sense and control the surface temperature of the fuser roller 12, and because such built up heat can cause the hollow metallic core of the fuser roller 12 to warp and even crack within the second length portions L2, L3 thereof.

Accordingly, in order to reduce the surging temperatures over the second length portions L2, L3, the present invention further includes within each of the second length portions L2, L3 a member shown as 30 for absorbing and diffusing heat, that is, for absorbing and dissipating heat, from the heated core 24 within such length portions L2, L3. The heat absorbing and diffusing member 30 is preferably metallic. For example, the member 30 can be made from aluminum or copper. Preferably the member 30 has a generally cylindrical shape and an outer diameter that is substantially equal to the inner diameter of the core 24 at such second length portion L2, L3. As shown, the cylindrical member 30 is mounted within, and in full all-around contact with the inside of the core 24. As an example, in a fuser roller which includes an aluminum core 24 of about 0.250 of an inch in thickness, the member 30 can be a copper cylindrical section having a thickness of 0.250 to 0.50 of an inch. In general however, the design of the member 30 should include dimensional selections which take into account possible dissimilar thermal expansions of the core 24 and the member 30.

Operatively, when the heat source 22 is turned on during an extended run period, the segment of the core 24 within the first length portion L1 will be heated first. Some of the heat in that particular segment of the core 24 flows radially to heat the elastomeric layers over such segment, and a significant amount of the heat in that particular segment will flow longitudinally through the core 24 from the segment within the first length portion L1 to the segments within the second length portions L2, L3. Within each second length portion L2, L3, some of that significant amount of heat in the core-segment is readily absorbed and dissipated by the member 30 to the inside of the core 24, away from the elastomeric layers 26, 28. As such, only some of the heat reaching those segments of the core 24 within the second length portions L2, L3 is available to heat the layers 26, 28 within such second length portions. An immediate consequence of such absorption and dissipation of heat within the second length portions L2, L3 is a reduction in the heat buildup in the elastomeric layers thereat, and hence in the heating and surface temperature of such second length portions L2, L3. An undesirable temperature-surge as measured in the example above is thereby prevented.

In a fusing apparatus such as 10, the frequent cycling on and off of the heat source 22 ordinarily is such that the fuser roller 12 is rarely ever heated to a thermal saturation point. Consequently, a temperature gradient will exist between the L1 and L2, L3 segments of the core 24 for such radial and longitudinal heat flow through the core 24 as described above.

As further shown, the fuser roller 12 may also include at least a second heat absorbing and diffusing member shown as 32 for additionally absorbing and dissipating heat from the first heat absorbing member 30. The second heat absorbing and diffusing member 32 is preferably also metallic. For example, the member 32 can be made from aluminum or copper, and as shown may have a generally cylindrical shape such that it can be mounted to the inside of the first heat absorbing and dissipating member 30 within such second length portion L2, L3. As shown, the cylindrical member 32 is mounted within, and in full all-around contact with the inside of the first heat absorbing and dissipating member 30. Again, the selected dimensions for the additional member such as 32 should take into account any possible differences between the thermal expansions of contacting members as constructed.

The addition of the at least second heat absorbing and dissipating member 32 as such is the same as making the first member 30 progressively thicker towards the very end segments shown as L4, L5 of the second length portions L2, L3 of fuser roller 12. Although the members 30, 32 are shown arranged in a stepwise manner, other arrangements which approximate the progressive thickness concept are of course equally acceptable. The end segments L4, L5 for example represent those length portions of the fuser roller 12 over which no substrates are ever contactably passed. As such, the difference for example between L2 and L4 is a length portion over which substrates wider than the substrates 20, for example legal size substrates, are infrequently run. The build up of heat over such a length portion will therefore be slightly less than a similar build up over the segment or portion of the roller 12 indicated as L4.

Although the description of this invention has been presented with particular reference to a preferred embodiment, it is understood that modifications and variations can be effected within the spirit and scope of the invention.

What is claimed is:

1. A fuser roller for use in a heat and pressure roller-type fusing apparatus to fuse toner images being carried on a substrate, the fuser roller including:

(a) a hollow metallic core;

(b) an elastomeric outer layer formed over said core;

(c) a heat source mounted within said core for heating said core;

(d) a first length portion for contacting the image carrying substrate, said first length portion being substantially equal to the cross-track dimension of the substrate;

(e) a second length portion adjoining said first length portion and one end of said fuser roller; and (f) a heat absorbing and diffusing member mounted inside said core for absorbing and diffusing heat from said core within said second length portion of said roller, thereby reducing the heating and temperature of the surface of such second length portion.

2. The fuser roller of claim 1 wherein said heat absorbing and diffusing member is metallic.

3. The fuser roller of claim 2 wherein said metallic core is made from aluminum having a thickness of about 0.25 to 0.50 of an inch.

4. The fuser roller of claim 2 wherein said heat absorbing and dissipating member is made from copper having a thickness of about 0.25 to 0.50 of an inch.

5. The fuser roller of claim 4 wherein said heat absorbing and dissipating member is mounted all around and in contact with the inside of said hollow core.

6. The fuser roller of claim 5 wherein said heat absorbing and dissipating member has a progressively increasing thickness towards said one end of the fuser roller.

7. The fuser roller of claim 6 including such a heat absorbing and dissipating member at each end of the fuser roller.

8. A heat and pressure roller-type fusing apparatus for fusing toner images to a substrate, the fusing apparatus comprising:

(a) a generally cylindrical pressure roller; and (b) a fuser roller forming a fusing nip with said pressure roller, said fuser roller having a length greater than the cross-track dimension of the substrate, and including:

(i) a hollow metallic core;

(ii) an elastomeric outer layer formed over said core;

(iii) a heat source mounted within said core for heating said core;

(iv) a first length portion for contacting the image carrying substrate, said first length portion being substantially equal to the cross-track dimension of the substrate;

(v) a second length portion adjoining said first length portion and an end of said fuser roller; and (vi) a heat absorbing and diffusing member mounted within said core for absorbing and diffusing heat from said core over said second length portion of said roller, thereby reducing the heating and temperature of the surface of such second length portion.

* * * * *